US009305728B2

(12) United States Patent
Suzuki et al.

(10) Patent No.: US 9,305,728 B2
(45) Date of Patent: Apr. 5, 2016

(54) ELECTROMAGNETIC ACTUATING APPARATUS, IN PARTICULAR FOR CAMSHAFT ADJUSTMENT OF AN INTERNAL COMBUSTION ENGINE

(71) Applicant: KENDRION (Villingen) GmbH, Villingen-Schwenningen (DE)

(72) Inventors: Tsuneo Suzuki, Mönchweiler (DE); Harald Burkart, Villingen-Schwenningen (DE); Soeren Rosenbaum, Villingen-Schwenningen (DE); Mikhail Revin, Villingen-Schwenningen (DE)

(73) Assignee: KENDRION (VILLINGEN) GMBH, Villingen-Schwenningen (DE)

( * ) Notice: Subject to any disclaimer, the term of this patent is extended or adjusted under 35 U.S.C. 154(b) by 0 days.

(21) Appl. No.: 14/196,397

(22) Filed: Mar. 4, 2014

(65) Prior Publication Data

US 2014/0253265 A1 Sep. 11, 2014

(30) Foreign Application Priority Data

Mar. 6, 2013 (DE) ..... 10 2013 102 241

(51) Int. Cl.

| | |
|---|---|
| ***H01H 36/00*** | (2006.01) |
| ***F01L 13/00*** | (2006.01) |
| ***H01F 7/16*** | (2006.01) |

(52) U.S. Cl.

CPC ..... *H01H 36/0006* (2013.01); *F01L 13/0036* (2013.01); *H01F 7/1646* (2013.01); *F01L 2013/0052* (2013.01); *F01L 2820/031* (2013.01)

(58) Field of Classification Search

CPC ..... F01L 13/0036; F01L 2013/0052; F01L 2820/031; H01F 7/1646; H01H 36/0006

USPC ..... 335/80, 220–229; 251/129.15–129.22

See application file for complete search history.

(56) References Cited

U.S. PATENT DOCUMENTS

| | | | | |
|---|---|---|---|---|
| 3,344,377 | A * | 9/1967 | Clements | 335/259 |
| 4,503,411 | A * | 3/1985 | Lofstrand | 335/259 |

(Continued)

FOREIGN PATENT DOCUMENTS

| | | | |
|---|---|---|---|
| DE | 32 39 153 | A1 | 4/1984 |
| DE | 29912431 | | 9/1999 |
| DE | 102006025559 | | 12/2007 |
| DE | 10 2007 037 232 | A1 | 2/2009 |
| DE | 102009006061 | | 7/2010 |

(Continued)

*Primary Examiner* — Bernard Rojas

(74) *Attorney, Agent, or Firm* — Jonathan A. Kidney; TechLaw LLP

(57) ABSTRACT

An electromagnetic actuating apparatus with a first armature arrangement axially displaced between a rest and actuating position and connected to a first actuating element. A pole core is brought into magnetic operative connection with the first armature arrangement. An axially oriented coil unit is energized, influencing the magnetic connection between the first pole core and the first armature arrangement, and a second armature arrangement is connected to a second actuating element and axially displaced between a rest and actuating position. A second pole core can be brought into magnetic operative connection with second armature arrangement, its pole core oriented axially to first pole core influencing its magnetic operative connection with second armature arrangement. A permanent magnet unit, the magnet axis is oriented radially and stationary, generates magnetic operative connection both between the first pole core and first armature arrangement and between the second pole core and second armature arrangement.

18 Claims, 7 Drawing Sheets

(56) References Cited

U.S. PATENT DOCUMENTS

| | | | | |
|---|---|---|---|---|
| 5,903,203 | A * | 5/1999 | Elenbaas | 335/179 |
| 7,637,475 | B2 * | 12/2009 | Adams | 251/129.01 |
| 8,339,225 | B2 * | 12/2012 | Nendel | 335/229 |
| 2010/0180850 | A1 * | 7/2010 | Lengfeld et al. | 251/129.01 |

FOREIGN PATENT DOCUMENTS

| | | |
|---|---|---|
| DE | 102010025766 | 1/2012 |
| DE | 102011009327 | 7/2012 |
| DE | 102011079189 | 1/2013 |
| WO | 2010/112111 A1 | 10/2010 |

* cited by examiner

ELECTROMAGNETIC ACTUATING APPARATUS, IN PARTICULAR FOR CAMSHAFT ADJUSTMENT OF AN INTERNAL COMBUSTION ENGINE

CROSS-REFERENCE TO RELATED APPLICATION(S)

This application claims the benefit of DE Patent Application No. 10 2013 102 241.3 filed Mar. 6, 2013, the contents of which are hereby incorporated by reference in its entirety.

BACKGROUND

1. Field

The invention relates to an electromagnetic actuating apparatus. More, particularly to an actuating apparatus for internal combustion engines, and for camshaft adjustment.

2. Background

An electromagnetic actuating apparatus of the generic type is known as an apparatus for camshaft adjustment of an internal combustion engine from DE 10 2007 037 232 A1.

Apparatuses of this type for camshaft adjustment have two or more plungers which are moved in the same direction or in opposite directions or independently of one another by coil units being energized, in order to bring about an axial, predefined adjustment of the camshaft by interaction with in each case one control groove of the camshaft, as a result of which a cam can be assigned different cam tracks, in order for it to be possible, for example, to carry out a cylinder switch-off or a valve lift switchover.

The known electromagnetic actuating apparatus according to DE 10 2007 037 232 A1 has a multiple-part plunger unit which consists of a hollow plunger and an inner plunger which is received by the former, both the hollow plunger being assigned an armature which interacts with a pole core and the inner plunger which is configured as a permanent magnet being assigned a flat armature. Furthermore, a first coil unit which encloses the pole core and a second coil unit which encloses the hollow and inner plungers and is arranged axially with respect to the first coil unit in the actuating apparatus are provided. The energizing of said second coil unit brings about a movement of the flat armature of the hollow plunger in the actuating direction (it is therefore pushed out of the housing into an actuating position), whereas the armature of the inner plunger, however, remains adhering magnetically to the pole core on account of its permanent-magnetic property (the inner plunger therefore remains in its pushed-in rest position).

In order to extend the inner plunger from its retracted rest position into its actuating position, the first coil unit is energized in such a way that the armature of the inner plunger is repelled by the pole core on account of the permanent-magnetic property.

By way of a known electromagnetic actuating apparatus of this type, different penetration depths into the associated control grooves for the "part plungers" of the multiple-part plunger unit are possible in interaction with the control grooves of a camshaft, with the result that corresponding control grooves can be selected in a selective manner and moved along, with the result that the intended axial adjustment is brought about during rotation of the camshaft.

In this known actuating apparatus, however, there is the risk that the multiple-part plunger unit with a hollow and an inner plunger does not always operate in a disruption-free manner in all operating states of an internal combustion engine. Furthermore, two coil units which lead both to high material outlay and to high energy expenditure are required for the operation of said known actuating apparatus.

Accordingly, system(s) and method(s) for addressing one or more deficiencies in the prior art are presented in the detailed description below.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, an electromagnetic actuating apparatus is provided, comprising:

a first armature arrangement which can be displaced in the axial direction between a rest position and an actuating position and is connected to a first actuating element, a first pole core which can be brought into a magnetic operative connection with the first armature arrangement, an axially oriented coil unit, which can be energized, for influencing the magnetic operative connection between the first pole core and the first armature arrangement, and a second armature arrangement which is connected to a second actuating element and can be displaced in the axial direction between a rest position and an actuating position, characterized in that a second pole core which can be brought into a magnetic operative connection with the second armature arrangement is provided, which second pole core is oriented axially with respect to the first pole core in order to influence its magnetic operative connection with the second armature arrangement by way of the coil unit, and a permanent magnet unit is provided, the magnet axis of which is oriented radially and is stationary in order to generate a magnetic operative connection both between the first pole core and the first armature arrangement.

BRIEF DESCRIPTION OF THE DRAWINGS

In the following text, the invention will be described in detail using exemplary embodiments with reference to the appended figures, in which.

DETAILED DESCRIPTION

Figure 1:
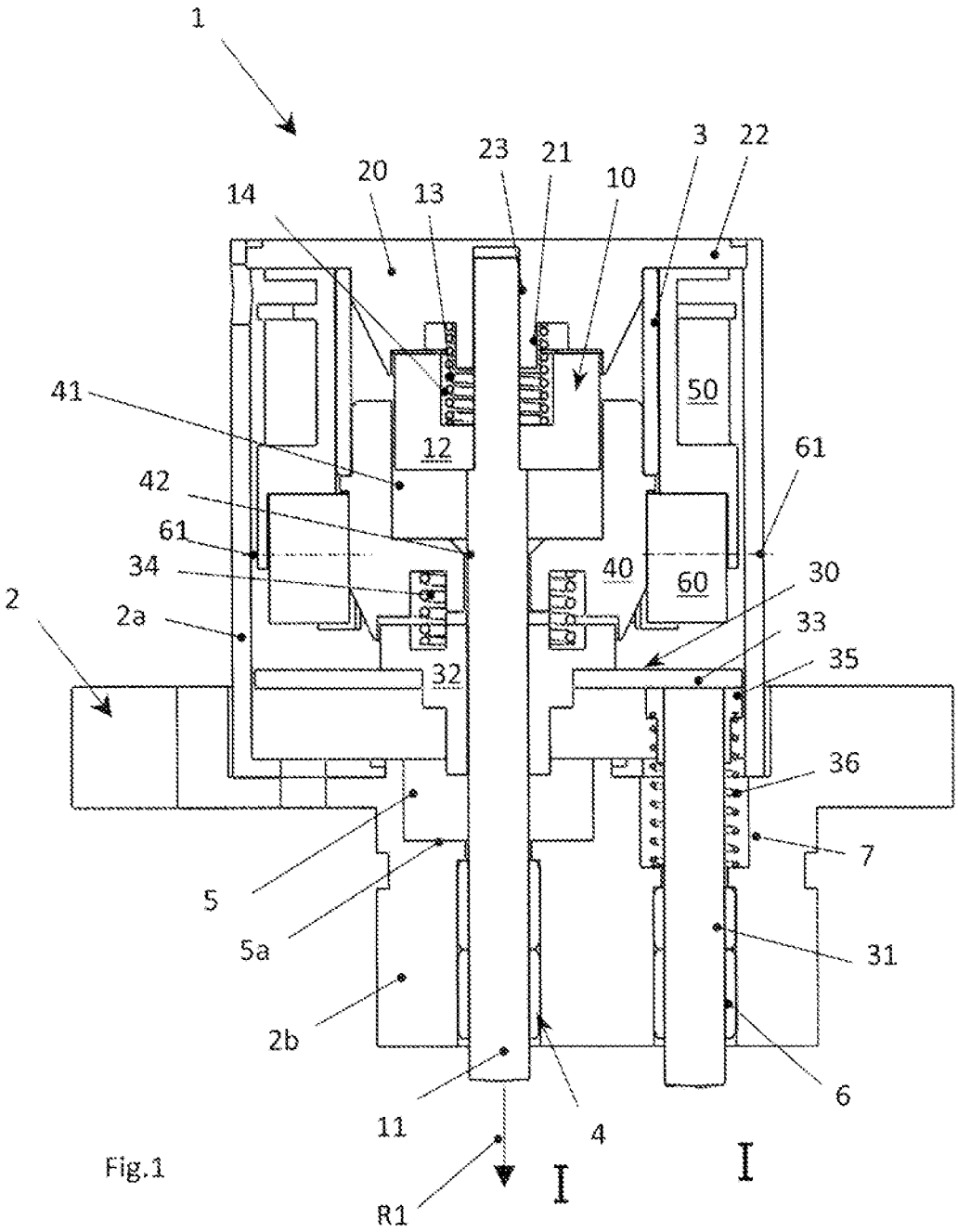
FIG. 1 shows a sectional illustration of an electromagnetic actuating apparatus according to the invention.

Proceeding from the prior art, it is an object of the invention to provide an electromagnetic actuating apparatus of the type mentioned at the outset, which electromagnetic actuating apparatus guarantees an energy-saving and functionally reliable operating method in all operating conditions, without a complicated construction being necessary for this purpose.

An electromagnetic actuating apparatus of this type, one or embodiments comprise a first armature arrangement which can be displaced in the axial direction between a rest position and an actuating position and is connected to a first actuating element, a first pole core which can be brought into a magnetic operative connection with the first armature arrangement, an axially oriented coil unit, which can be energized, for influencing the magnetic operative connection between the first pole core and the first armature arrangement, and a second armature arrangement which is connected to a second actuating element and can be displaced in the axial direction between a rest position and an actuating position, is distinguished according to the invention by the fact that

- a second pole core which can be brought into a magnetic operative connection with the second armature arrangement is provided, which second pole core is oriented axially with respect to the first pole core in order to influence its magnetic operative connection with the second armature arrangement by way of the coil unit, and
- a permanent magnet unit is provided, the magnet axis of which is oriented radially in order to generate a magnetic operative connection both between the first pole core and the first armature arrangement and between the second pole core and the second armature arrangement.

In said actuating apparatus according to the invention, a permanent magnet unit is provided which holds the two armature arrangements in their rest positions, in which the first armature arrangement is in a magnetic operative connection with the first pole core and the second armature arrangement is in a magnetic operative connection with the second pole core, without energy being necessary for this operating position. The coil unit is required merely for ensuring that the magnetic operative connections of the two armature arrangements with the respective pole core are influenced, with the result that either the magnetic operative connection between the first armature arrangement and the first pole core or the magnetic operative arrangement between the second armature arrangement and the second pole core is released, in order to make a movement of the first armature arrangement together with the first actuating element or a movement of the second armature arrangement together with the second actuating element possible as a result.

According to a first development of the invention, a first spring element is provided which prestresses the first armature arrangement against the first pole core in the actuating direction. Furthermore, according to a further refinement of the invention, a second spring element is provided which prestresses the second armature arrangement against the second pole core in the actuating direction.

In this way, if the magnetic operative connection between the pole cores and the associated armature arrangements is released, a movement of the armature arrangements together with the respective actuating elements from their rest positions into the actuating positions is made possible by way of the prestressed spring elements.

To this end, according to one advantageous development of the invention, the permanent magnet unit is configured in such a way that, in the case of a non-energized coil unit, both the first armature arrangement is brought into a magnetic operative connection with the first pole core and the second armature arrangement is brought into a magnetic operative connection with the second pole core. To this end, a permanent magnet unit of this type has a field strength which is such that the holding force which is brought about as a result of the armature arrangements on the respective pole cores cannot be overcome by the respective spring elements, that is to say, in accordance with the development, the permanent magnet unit is configured in such a way that the first and second armature arrangements are held in their rest positions by way of the generated magnetic operative connection.

In a further refinement of the invention, it is provided that the coil unit is configured in such a way that, depending on the current application direction, either the magnetic operative connection between the first armature arrangement and the first pole core or the operative connection between the second armature arrangement and the second pole core is canceled.

A particularly advantageous further refinement of the invention results if the second armature arrangement comprises an armature with an armature plate, the armature plate being in an operative connection with the second actuating element.

Furthermore, it is provided in one refinement of the invention that the second pole core is configured with a blind bore for displaceably receiving the first armature arrangement. In this way, a particularly compact arrangement of the two pole cores in the actuating apparatus is possible.

The structural construction of the actuating apparatus according to the invention is simplified further by virtue of the fact that, in accordance with the development, a tubular receiving element is provided which is connected at one end to the first pole core and at the other end to the second pole core.

It is particularly advantageous if, according to one refinement of the invention, at that end of the tubular receiving element which is adjacent to the first pole core, the coil unit is arranged on said receiving element. The permanent magnet unit is then preferably arranged radially circumferentially on the second pole core.

A further compact arrangement results from the fact that, in accordance with the development, the permanent magnet unit is arranged axially adjacently to the coil unit in the actuating direction.

The permanent magnet unit is preferably constructed from circularly annular permanent magnets. In this way, a magnetic field which is generated by said permanent magnets can be built up which is substantially homogeneous and, in particular, provides a high holding force for generating the magnetic operative connections between the first and second armature arrangements and the first and second pole cores, respectively.

According to a further refinement of the invention, the first actuating element is configured as a plunger, on which the first armature arrangement is arranged fixedly in terms of movement and the second armature arrangement is arranged displaceably. It is also provided in a corresponding way, in accordance with the development, that the second actuating element is also configured as a plunger and is arranged axially offset in the actuating apparatus.

It is particularly advantageous if, according to a further refinement of the invention, the plunger of the second actuating element is prestressed counter to the actuating direction by means of a spring element and bears with a full-surface fit against the armature plate of the second armature arrangement. In this way, a plunger of this type is connected to the armature plate neither in a non-positive manner nor in a material-to-material manner, but rather bears loosely against said armature plate. This results in easy running during the movement of the plunger of the second armature arrangement.

The actuating apparatus according to the invention can advantageously be used as an actuating unit for an internal combustion engine, in particular for the adjustment of a camshaft of the internal combustion engine.

The electromagnetic actuating apparatus 1 according to FIG. 1 comprises a multiple-part housing 2 for receiving its components and is constructed from a first tubular housing part 2*a* and a second housing part 2*b*. The second housing part 2*b* is flange-connected to the first housing part 2*a* in the axial direction.

At one end of the first housing part 2*a*, a first pole core 20 forms an end side of said first housing part 2*a*. Said first pole core 20 is assigned a first armature arrangement 10 which consists of an armature 12 which is arranged fixedly in terms of movement on a first actuating element 11. Said first actuating element 11 is configured as a plunger and serves as a pin for guiding the first armature arrangement 10. The plunger 11 is mounted firstly in a centric bore 23 of the pole core 20 and secondly in the second housing section 2*b*.

In the rest position I (shown in FIG. 1) of the first armature arrangement 10 and the plunger 11, in which rest position I the armature 12 bears against the pole core 20, the armature 12 is prestressed in the actuating direction R1 by means of a spring element 13. In order to guide said spring element 13, the armature 12 has a blind bore 14 and the pole core 20 has an annular flange 21.

The first pole core 20 has a radially circumferential flange 22 which produces the connection to the first housing part 2*a*, and is connected, furthermore, to a tubular receiving element 3 which receives a second pole core 40 at the opposite end. Said second pole core 40 has a blind bore 41, the contour of which is adapted to the outer contour of the armature 12 of the first armature arrangement 10, with the result that a movement of said armature 12 together with the plunger 11 from the rest position I in the actuating apparatus R1 into an actuating position II is made possible. The end-side spacing of said second pole core 40 from the first pole core 20 is kept low, with the result that the armature 12 is still partially enclosed by the second pole core 40 even in that position of the armature 12 which is shown. Furthermore, said second pole core 40 has a centric through hole 42 for receiving the plunger 11.

A bore 4 is provided in the second housing section 2*b* for mounting the plunger 11 of the first armature arrangement 10, which bore 4 ends in a blind bore 5 in the direction toward the second pole core 40. In the space which results between the second pole core 40 and the blind hole bottom 5*a* of the blind bore 5, an armature 32, arranged displaceably on the plunger 11, of a second armature arrangement 30 is provided which interacts with the second pole core 40. A spring element 34 is arranged between said armature 32 and the second pole core 40, with the result that the armature 32 is prestressed in the actuating direction R1 when the armature 32 bears against the second pole core 40.

In addition to the armature 32, said second armature arrangement 30 comprises an armature plate 33 which is connected to said armature 32 and is adapted on the circumferential side to the inner contour of the first tubular housing part 2*a*, and a second actuating element 31 which is mounted in the second housing part 2*b* by means of a bore 6 and is likewise configured as a plunger in accordance with the first actuating element 11.

In order to press said plunger 31 loosely onto the armature plate 33 on the end side, a spring element 36 is provided which is supported firstly in a blind bore 7 of the bore 6 and secondly on a receiving element 35 which is arranged on the end side of the plunger 31.

In that position of the second armature arrangement 30 which is shown in FIG. 1, the plunger 31 is situated in its rest position I.

A coil unit 50, which can be energized, is arranged on the receiving element 3 and encloses the first pole core 20 and the first armature arrangement 10 which bears against said pole core 20. Said coil unit 50 is adjoined in the axial direction by a circularly annular permanent magnet unit 60 which encloses the second pole core 40. Said permanent magnet unit 60 consists of a plurality of circular segment-like, for example six circular segment magnets. Said circular segment magnets are arranged in the actuating apparatus 1 in such a way that their magnet axes 61 are oriented in the radial direction with regard to the plunger 11 which forms the central axis.

Figure 4:
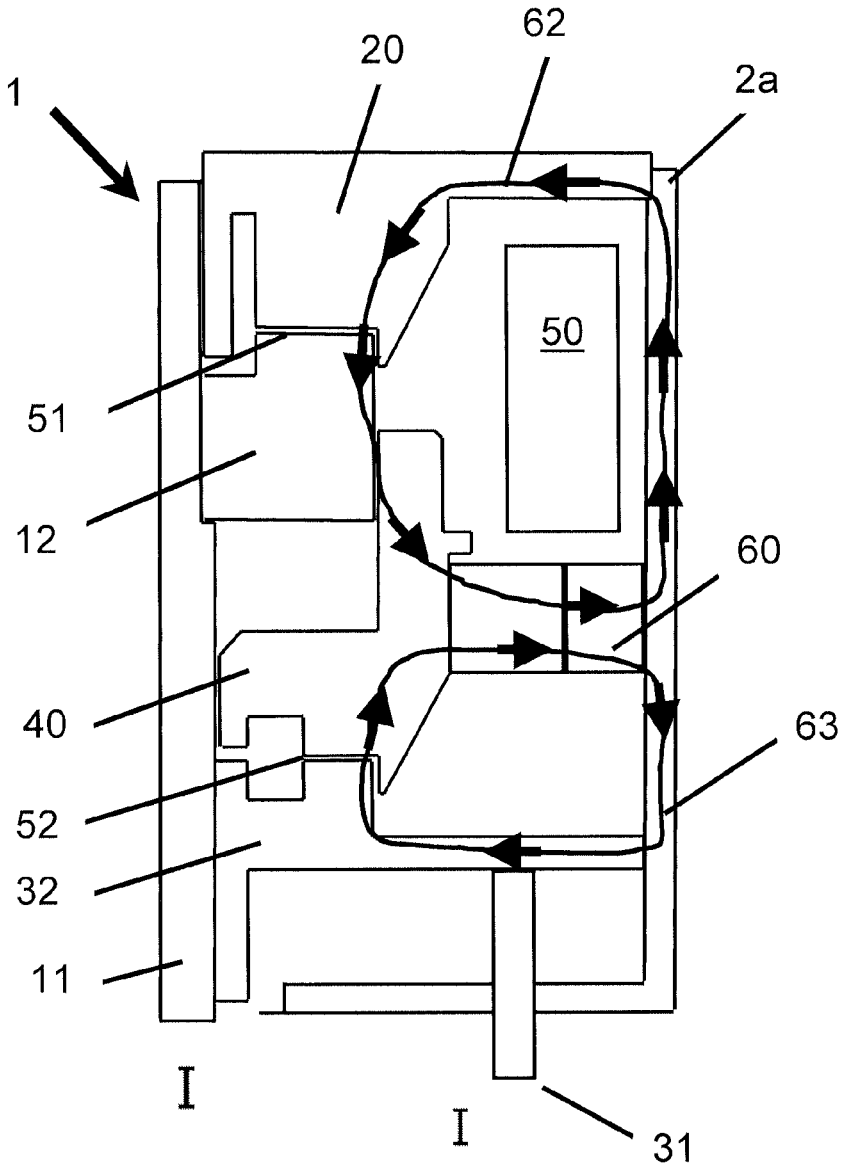
FIG. 4 shows a diagrammatic illustration of the electromagnetic actuating apparatus according to FIG. 1 with the magnetic field line course which is generated by the permanent magnet unit for adjusting the first actuating unit from its rest position into its actuating position.
Figure 5:
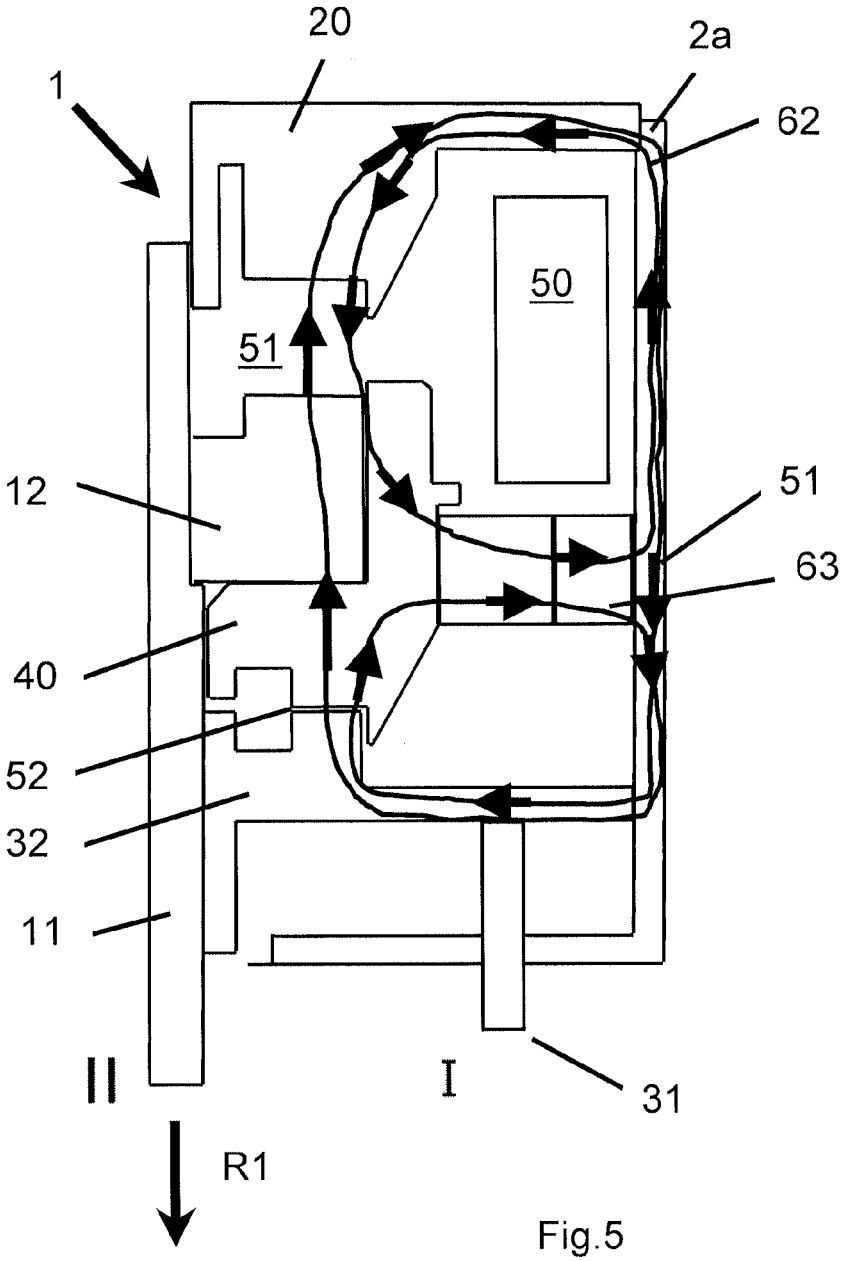
FIG. 5 shows a diagrammatic illustration of the electromagnetic actuating apparatus according to FIG. 1 with the magnetic field line course which is generated by the permanent magnet unit and the coil unit for adjusting the first actuating unit from its rest position I into its actuating position II.

FIG. 4 shows the magnet line course which is brought about by said permanent magnet unit 60 in the case of a non-energized coil unit 50 and a state of the electromagnetic actuating apparatus 1 according to FIG. 1. In the rest position I of the two plungers 11 and 31, both the armature 12 of the first armature arrangement 10 bears against the first pole core 20 and the armature 32 of the second armature arrangement 30 bears against the second pole core 40.

Two magnetic circuits 62 and 63 are produced by the radial orientation of the permanent magnet unit 60. One magnetic circuit 62 encloses the coil unit 50, by the associated field lines running, starting from the permanent magnet unit 60, via the first housing part 2*a*, the first pole core 20, the armature 12 of the first armature arrangement 10 and via the second pole core 40 back into the permanent magnet unit 60. The permanent magnet unit 60 is arranged in such a way that the direction of the field lines corresponds to the indicated directional arrows of the magnetic circuit 62.

The other magnetic circuit 63 is formed on the side which lies opposite the coil unit 50 and runs, starting from the permanent magnet unit 60, via the second pole core 40 and the armature 32 of the second armature arrangement 30 and is closed again via the first housing part 2*a*. The direction of the field lines also corresponds here to the indicated directional arrows of the magnetic circuit 63.

Since both the armature 12 of the first armature arrangement 10 bears against the first pole core 10 and the armature 32 of the second armature arrangement 30 bears against the second pole core 40, the associated gaps S1 and S2 are negligible, which results in a high field line density at said gaps S1 and S2 and the magnetic forces which are produced as a result hold both the armature 12 and the armature 32 on the pole core 20 and 40, respectively. Moreover, the armature 12 is also enclosed on the edge side by the second pole core 40 in this position of said armature 12, with the result that the magnetic resistance is also low there. The properties of the permanent magnet unit 60 are selected in such a way that the magnetic forces which are generated at the gaps S1 and S2 are greater than the corresponding restoring forces of the two spring elements 13 and 34. In this way, the plungers 11 and 31 are held in their rest positions I.

In the following text, the function of the electromagnetic actuating apparatus 1 and its interaction with a camshaft of an internal combustion engine will be explained using FIGS. 2, 3 and 5 to 8.

Figure 2:
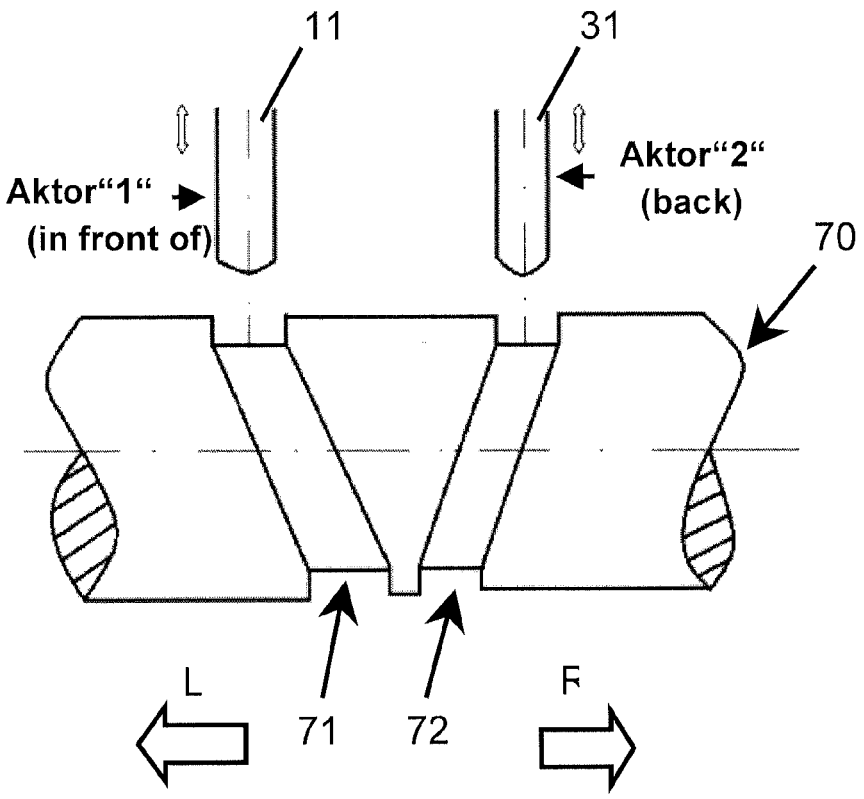
FIG. 2 shows a diagrammatic illustration of a camshaft with control grooves and associated actuating elements of an actuating apparatus according to FIG. 1.

FIG. 2 shows a control section of a camshaft 70 with two control grooves 71 and 72, with the result that axial pushing to and fro of the camshaft 70 is brought about by interaction with a plunger as first actuating element 11 and a further plunger as second actuating element 31. If the plunger 11 is extended out of its rest position I into its actuating position II, that is to say is lowered into the control groove 71, simultaneous rotation of the camshaft brings about its displacement in the direction L. The pushing back of the camshaft 70 in the direction R into its starting position takes place by extension of the plunger 31 from its rest position I into the control groove 72 with simultaneous rotation of the camshaft 70, but only after the plunger 11 has been withdrawn into its rest position I.

Figure 3:
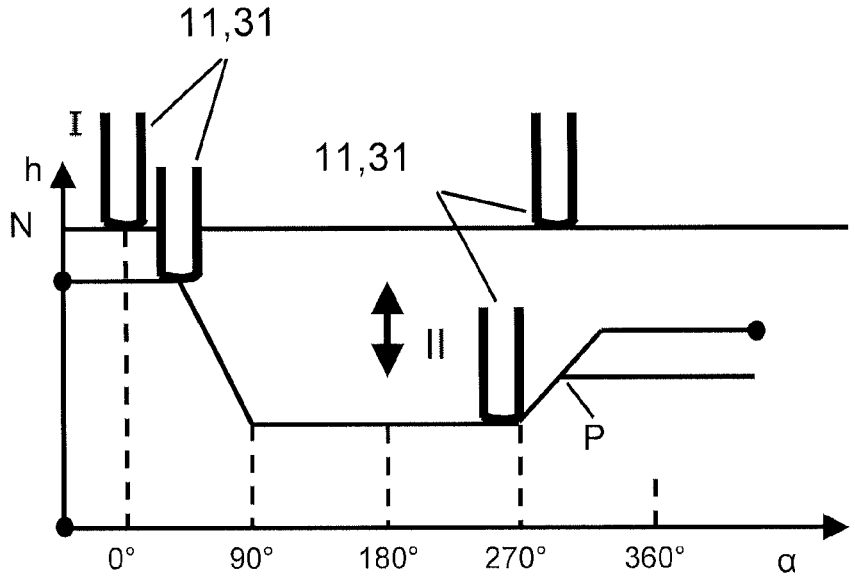
FIG. 3 shows a rotary angle/lift travel diagram for illustrating the interaction of the actuating elements with the control grooves of the camshaft according to FIG. 2.

FIG. 3 shows the associated actuating movements of the two plungers 11 and 31 in a 360° developed view of the two control grooves 71 and 72. The energizing of the coil unit 50 is therefore synchronized with the rotational movement of the camshaft 70.

In order to control the plunger 11 from its rest position I, corresponding to the zero position N which is shown in FIG. 3, into its actuating position II, with the result that said plunger 11 is lowered into the control groove 71, energizing of the coil unit 50 takes place during a rotational movement of the camshaft 70 from 0° to 90°. Here, the energizing of the coil unit 50 takes place in such a way that, according to FIG. 5, a magnetic circuit 51 is generated which first of all runs in the axial direction via the first pole core 20, the armature 12 of the first armature arrangement 10, the second pole core 40, the armature 32 of the second armature arrangement 30 and is closed via the first housing section 2*a*. Here, the field lines of the magnetic circuit 62 which are generated by the permanent magnet unit 60 are neutralized in the region of the first pole core 20, the armature 12 of the first armature arrangement 10 and the second pole core 40, with the result that the armature 12 is moved together with the plunger 11 in the actuating direction R1 under the spring force of the prestressed spring element 13, until the armature 12 comes into contact with the second pole core 40. The plunger 11 has reached its actuating position II and is situated in engagement with the control groove 71.

The further magnetic circuit 63 which is generated by the permanent magnet unit 60 is boosted in contrast, with the result that the holding force of the armature 32 of the second armature arrangement 30 on the second pole core 40 is increased. The plunger 31 of the second armature arrangement 30 remains in its rest position I.

The plunger 11 remains in its actuating position II until the camshaft 70 has reached the rotary angle 270° and in the process the camshaft 70 is displaced axially in the direction L. From said rotary angle position, the groove depth of the control groove 71 decreases, as a result of which the plunger 11 is pressed back in the direction of its rest position I, until, at a point P, the magnetic circuit 62 which is generated by the permanent magnet unit 60 leads in the region of the gap S1 to an increase in the field line density, so that the armature 12 of the first armature arrangement 10 is pulled onto the first pole core 20 counter to the spring force of the spring element 13 as a result and therefore again reaches its rest position I or the zero position.

Figure 6:
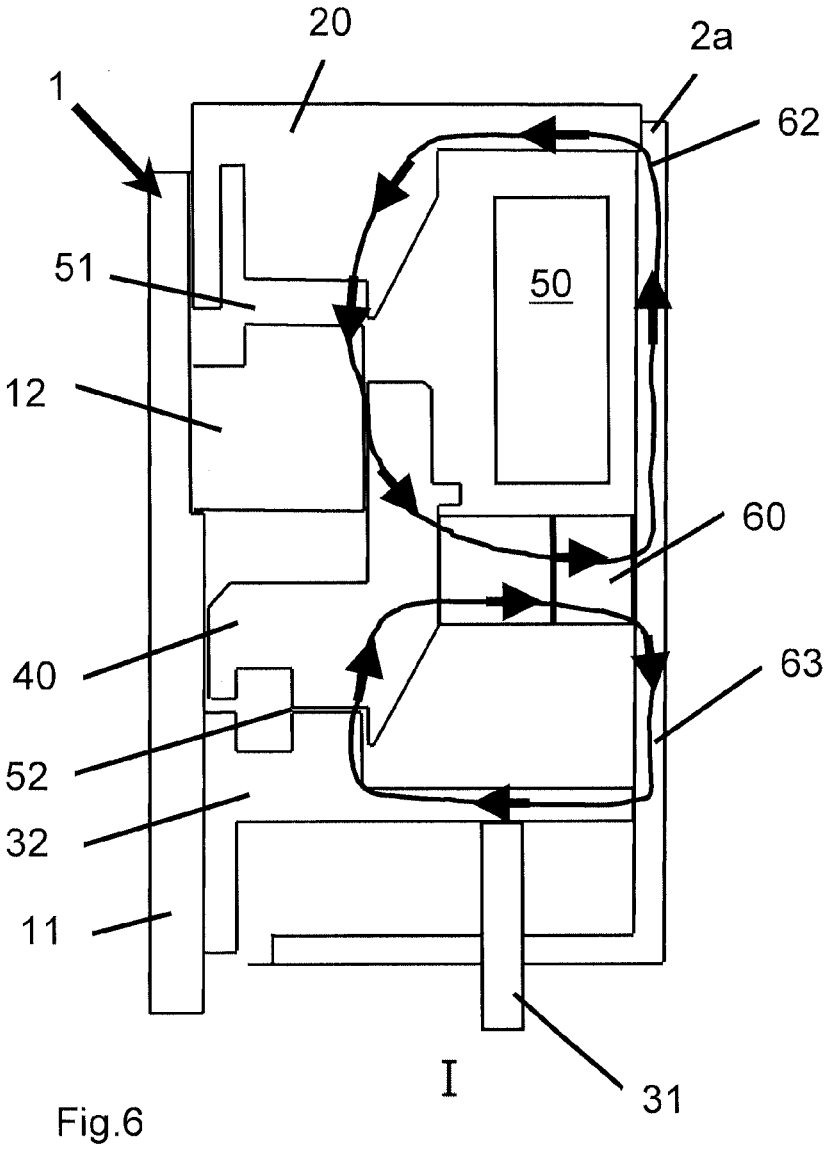
FIG. 6 shows a diagrammatic illustration of the electromagnetic actuating apparatus according to FIG. 1 with the magnetic field line course which is generated by the permanent magnet unit for restoring the first actuating unit from its actuating position II into its rest position I.

FIG. 6 shows that position of the armature 12 of the first armature arrangement 10 which corresponds to the point P, at which there is a first contact between said armature 12 and the first pole core 20 on the edge side and, as a result, a sufficient field strength is generated for the complete movement of the armature 12 into its rest position I.

Figure 7:
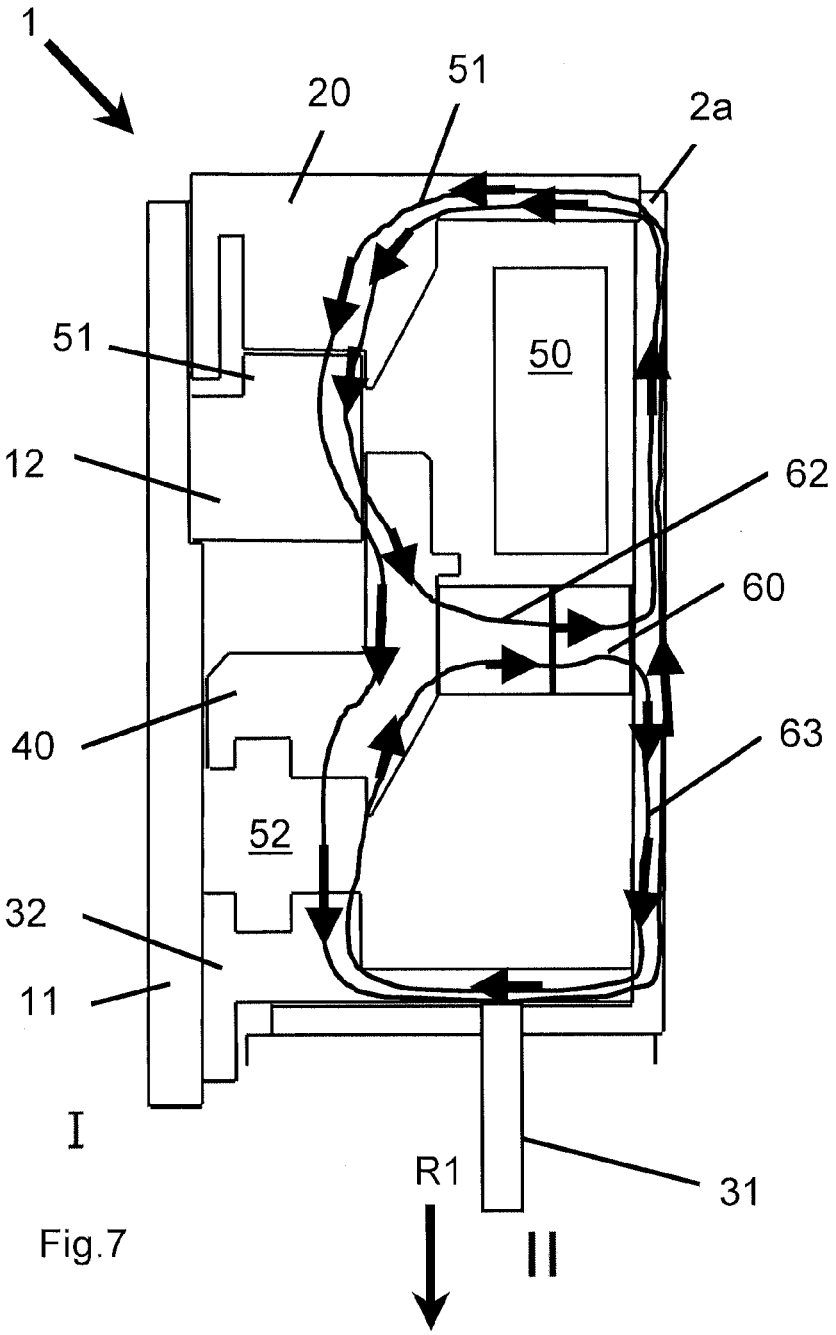
FIG. 7 shows a diagrammatic illustration of the electromagnetic actuating apparatus according to FIG. 1 with the magnetic field line course which is generated by the coil unit and the permanent magnet unit for adjusting the second actuating unit from its rest position I into its actuating position II.

In order to control the plunger 31 of the second armature arrangement 30, the coil unit 50 is energized with a reverse polarity, with the result that the field lines of the magnetic circuit 62 are no longer neutralized by the field lines of the coil unit 50 which are produced as a result, but rather the field lines of the further magnetic circuit 63 are neutralized, as is shown in FIG. 7. The field lines of the magnetic field 51 which is generated by the coil unit 50 is then directed in such a way that the magnetic field 63 of the permanent magnet unit 60 is neutralized, whereas its magnetic field 62 experiences boosting.

As a result, the holding force which is generated at the gap S2 is no longer sufficient to hold the armature 32 on the second pole core 40 counter to the spring force of the prestressed spring element 34, so that the second armature arrangement 30 is moved by the spring element 34 in the actuating direction R1 as a result, until the armature 32 comes into contact with the groove bottom 5*a* of the blind bore 5 and at the same time the plunger 31 is moved from its rest position I into its actuating position II counter to the spring element 36, with the result that said plunger 31 then engages into the control groove 72 of the camshaft 70.

The corresponding further course results again from FIG. 3, according to which the coil unit 50 is energized with the rotational movement of the camshaft 70 as far as the rotary angle of 90°. The camshaft 70 is pushed back again axially in the direction R by way of the rotational movement of said camshaft 70 as far as a rotary angle of 270°.

Figure 8:
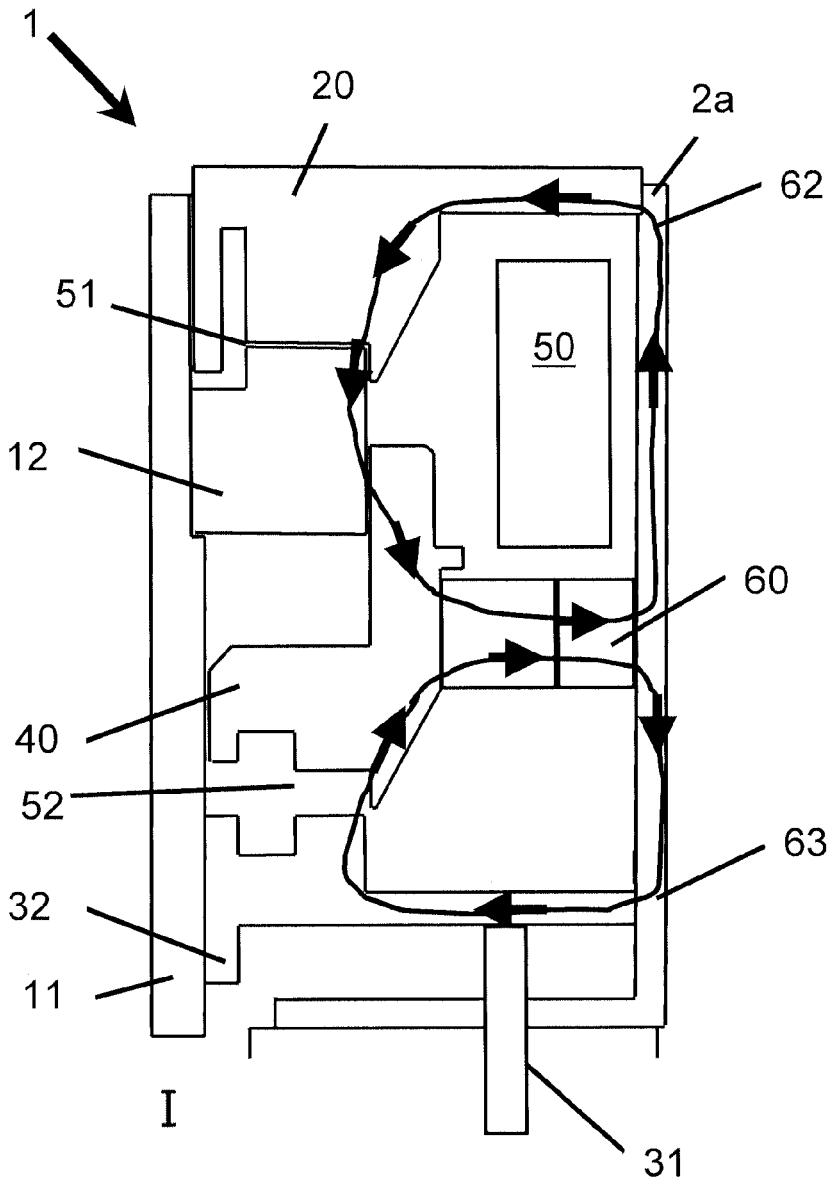
FIG. 8 shows a diagrammatic illustration of the electromagnetic actuating apparatus according to FIG. 1 with the magnetic field line course which is generated by the permanent magnet unit for restoring the second actuating unit from its actuating position II into its rest position I.

When the rotary angle which corresponds to the point P is reached, the plunger 31 is pushed back in the direction of its rest position I as a result of the decreasing groove depth of the control groove 72 to such an extent that, according to FIG. 8, the field line strength has then also risen in the region of the gap S2 between the armature 32 of the second armature arrangement 30 and the second pole core 40, to such an extent that the armature 32 is attracted by the second pole core 40 counter to the spring force of the spring element 34, so that the plunger 31 again reaches its rest position I as a result.

LIST OF REFERENCE NUMERALS

1 Electromagnetic actuating apparatus
2 Housing of the electromagnetic actuating apparatus 1
2*a* First housing part of the housing 2
2*b* Second housing part of the housing 2
3 Tubular receiving element of the electromagnetic actuating apparatus 1
4 Bore of the second housing part 2*b*
5 Blind bore of the second housing part 2*b*
6 Bore of the second housing part 2*b*
7 Blind bore
8
10 First armature arrangement
11 First actuating element of the first armature arrangement 10
12 Armature of the first armature arrangement 10
13 Spring element of the first armature arrangement
14 Blind bore of the armature 12

20 First pole core
21 Annular flange of the pole core 20
22 Flange of the pole core 20
23 Bore
30 Second armature arrangement
31 Second actuating element of the second armature arrangement 30
32 Armature of the second armature arrangement 30
33 Armature plate of the second armature arrangement 30
34 Spring element
35 Receiving element
36 Spring element
40 Second pole core
41 Blind bore of the second pole core 40
42 Through bore
50 Coil unit
51 Magnetic circuit of the coil unit 50
60 Permanent magnet unit
61 Magnet axis
62 Magnetic circuit of the permanent magnet unit 60
63 Magnetic circuit of the permanent magnet unit 60
70 Camshaft of an internal combustion engine
71 Control groove of the camshaft
72 Control groove of the camshaft While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

The invention claimed is:

1. An electromagnetic actuating apparatus comprising:

a first armature arrangement which can be displaced in its axial direction between a rest position and an actuating position and is connected to a first actuating element, a first pole core which can be brought into a magnetic operative connection with the first armature arrangement, an axially oriented coil unit, which can be energized, for influencing a magnetic operative connection between the first pole core and the first armature arrangement, and a second armature arrangement which is connected to a second actuating element and can be displaced in its axial direction between a rest position and an actuating position, wherein a second pole core which can be brought into a magnetic operative connection with the second armature arrangement is provided, which second pole core is oriented axially with respect to the first pole core in order to influence its magnetic operative connection with the second armature arrangement by way of the coil unit, and a permanent magnet unit is provided, its magnet axis of which is oriented radially and is stationary in order to generate a magnetic operative connection both between the first pole core and the first armature arrangement and between the second pole core and the second armature arrangement, wherein a first spring element is provided which prestresses the first armature arrangement against the first pole core in the actuating direction, wherein a second spring element is provided which prestresses the second armature arrangement against the second pole core in the actuating direction.

2. The electromagnetic actuating apparatus according to claim 1, wherein the coil unit is configured, depending on the current application direction, either to cancel the magnetic operative connection between the first armature arrangement and the first pole core or to cancel the operative connection between the second armature arrangement and the second pole core.

3. The electromagnetic actuating apparatus according to claim 1, wherein the second armature arrangement comprises an armature with an armature plate, the armature plate being in an operative connection with the second actuating element.

4. The electromagnetic actuating apparatus according to claim 1, wherein the second pole core is configured with a blind bore for displaceably receiving the first armature arrangement.

5. The electromagnetic actuating apparatus according to claim 1, wherein the permanent magnet unit is arranged axially adjacently to the coil unit in the actuating direction.

6. The electromagnetic actuating apparatus according to claim 1, wherein the permanent magnet unit is constructed from circularly annular segment-shaped permanent magnets.

7. The electromagnetic actuating apparatus according to claim 1, wherein the first actuating element is configured as a plunger, on which the first armature arrangement is arranged fixedly in terms of movement and the second armature arrangement is arranged displaceably.

8. The electromagnetic actuating apparatus according to claim 1, wherein the actuating apparatus is configured as an actuating unit for an internal combustion engine, in particular for adjusting a camshaft of the internal combustion engine.

9. The electromagnetic actuating apparatus according to claim 1, wherein a second spring element is provided which prestresses the second armature arrangement against the second pole core in the actuating direction.

10. The electromagnetic actuating apparatus according to claim 1, wherein the permanent magnet unit is configured, in the case of a non-energized coil unit, to bring both the first armature arrangement into a magnetic operative connection with the first pole core and to bring the second armature arrangement into a magnetic operative connection with the second pole core.

11. The electromagnetic actuating apparatus according to claim 1, wherein the coil unit is configured, depending on the current application direction, either to cancel the magnetic operative connection between the first armature arrangement and the first pole core or to cancel the operative connection between the second armature arrangement and the second pole core.

12. An electromagnetic actuating apparatus comprising:

a first armature arrangement which can be displaced in its axial direction between a rest position and an actuating position and is connected to a first actuating element, a first pole core which can be brought into a magnetic operative connection with the first armature arrangement, an axially oriented coil unit, which can be energized, for influencing a magnetic operative connection between the first pole core and the first armature arrangement, and a second armature arrangement which is connected to a second actuating element and can be displaced in its axial direction between a rest position and an actuating position, wherein a second pole core which can be brought into a magnetic operative connection with the second armature arrangement is provided, which second pole core is oriented axially with respect to the first pole core in order to influence its magnetic operative connection with the second armature arrangement by way of the coil unit, and a permanent magnet unit is provided, its magnet axis of which is oriented radially and is stationary in order to generate a magnetic operative connection both between the first pole core and the first armature arrangement and between the second pole core and the second armature arrangement, wherein the permanent magnet unit is configured, in the case of a non-energized coil unit, to bring both the first armature arrangement into a magnetic operative connection with the first pole core and to bring the second armature arrangement into a magnetic operative connection with the second pole core.

13. The electromagnetic actuating apparatus according to claim 12, wherein the permanent magnet unit is configured to hold the first and second armature arrangements in their rest positions by way of the generated magnetic operative connection.

14. An electromagnetic actuating apparatus comprising:

a first armature arrangement which can be displaced in its axial direction between a rest position and an actuating position and is connected to a first actuating element, a first pole core which can be brought into a magnetic operative connection with the first armature arrangement, an axially oriented coil unit, which can be energized, for influencing a magnetic operative connection between the first pole core and the first armature arrangement, and a second armature arrangement which is connected to a second actuating element and can be displaced in its axial direction between a rest position and an actuating position, wherein a second pole core which can be brought into a magnetic operative connection with the second armature arrangement is provided, which second pole core is oriented axially with respect to the first pole core in order to influence its magnetic operative connection with the second armature arrangement by way of the coil unit, and a permanent magnet unit is provided, its magnet axis of which is oriented radially and is stationary in order to generate a magnetic operative connection both between the first pole core and the first armature arrangement and between the second pole core and the second armature arrangement, wherein a tubular receiving element is provided which is connected at one end to the first pole core and at the other end to the second pole core.

15. The electromagnetic actuating apparatus according to claim 14, wherein at that end of the tubular receiving element which is adjacent to the first pole core, the coil unit is arranged on said receiving element.

16. The electromagnetic actuating apparatus according to claim 14, wherein the permanent magnet unit is arranged radially circumferentially on the second pole core.

17. An electromagnetic actuating apparatus comprising:

a first armature arrangement which can be displaced in its axial direction between a rest position and an actuating position and is connected to a first actuating element, a first pole core which can be brought into a magnetic operative connection with the first armature arrangement, an axially oriented coil unit, which can be energized, for influencing a magnetic operative connection between the first pole core and the first armature arrangement, and a second armature arrangement which is connected to a second actuating element and can be displaced in its axial direction between a rest position and an actuating position, wherein a second pole core which can be brought into a magnetic operative connection with the second armature arrangement is provided, which second pole core is oriented axially with respect to the first pole core in order to influence its magnetic operative connection with the second armature arrangement by way of the coil unit, and a permanent magnet unit is provided, its magnet axis of which is oriented radially and is stationary in order to generate a magnetic operative connection both between the first pole core and the first armature arrangement and between the second pole core and the second armature arrangement, wherein the second actuating element is configured as a plunger and is arranged axially offset in the actuating apparatus.

18. The electromagnetic actuating apparatus according to claim 17, wherein the plunger of the second actuating element is prestressed counter to the actuating direction by means of a spring element and bears with a full-surface fit against the armature plate of the second armature arrangement.

* * * * *